United States Patent [19]

Nelson

[11] 4,285,075

[45] Aug. 25, 1981

[54] SANITARY COMMODE MAT

[76] Inventor: Ann J. Nelson, P.O. Box 1107, Daytona Beach, Fla. 32015

[21] Appl. No.: 99,072

[22] Filed: Nov. 30, 1979

[51] Int. Cl.[3] ..... E03D 11/00

[52] U.S. Cl. ..... 4/252 A; 4/661

[58] Field of Search ..... 4/451, 661, 562, 563, 4/564, 565, 252 A

[56] References Cited

U.S. PATENT DOCUMENTS

| | | | |
|---|---|---|---|
| 918,396 | 4/1909 | Tracy | 4/252 A |
| 1,633,951 | 6/1927 | O'Toole | 4/252 A |
| 1,641,029 | 8/1927 | Gaudet | 4/252 A |
| 2,187,676 | 1/1940 | Biewen | 4/252 A |
| 2,771,613 | 11/1956 | Markiewicz | 4/252 A |
| 2,990,033 | 6/1961 | Arnold | 4/252 A X |
| 3,599,249 | 8/1971 | Reed | 4/451 |
| 3,654,064 | 4/1972 | Laumann | 4/451 X |
| 3,713,178 | 1/1973 | Mallette | 4/451 |
| 4,125,656 | 11/1978 | Creamer | 4/252 A |

*Primary Examiner*—Henry K. Artis

*Attorney, Agent, or Firm*—Duckworth, Hobby, Allen, Dyer & Pettis

[57] ABSTRACT

A mat adapted to be placed on the floor around the base of a commode or urinal. The mat is shaped to match the contours of the facility. A mat cover is provided formed from plastic or rubber like material having a solid base and a hingedly attached cover formed as grille work. A replaceable pad is contained in the mat cover and has an impervious plastic film base with layers of absorbent material overlaying the base, and a top previous film of non-woven material. The top film is sealed around its edges to the edges of the base film. When installed, urine falling on the grille work of the mat passes therethrough, through the permeable top film and is absorbed by the layers of absorbent material. The absorbent material may be impregnated with disinfectant and deodorizing chemicals. At suitable intervals, the mat cover is opened, the used pad removed and disposed of, the mat cover rinsed off, and a fresh pad installed.

13 Claims, 6 Drawing Figures

SANITARY COMMODE MAT

BACKGROUND OF THE INVENTION

1. Field of the Invention

The present invention relates to a commode mat, and more particularly to a mat having a disposable and replacable pad for absorbing urine to protect the floor from stain or damage and to maintain sanitary conditions.

2. Description of the Prior Art

A problem exists in restrooms and bathrooms having commodes or urinals used by males. It is quite common, due to carelessness, physical disabilities, or the like, for urine to collect on the floor around such facilities. This condition is unsanitary, results in objectionable odors, and can cause damage to carpets, tiles, and other flooring material. The result is that cleaning personnel must frequently clean and disinfect these areas, adding labor costs to commercial establishments and additional work for the housewife. The problem is particularly acute in institutions, rest homes and the like having young children, or aged, or physically infirm persons. Additionally, business establishments having publicly available restrooms experience this problem in attempting to keep clean, attractive, and sanitary facilities for their customers. In the home, it has been known to use small pieces of washable carpet cut to fit around the facility and which can be frequently laundered. This solution however, is costly in terms of requirement of frequent washing of the carpet. Although toilet bowl covers as shown in U.S. Pat. No. 3,085,611 to Dolnick and commode skirts taught by Hammond in U.S. Pat. No. 3,408,661 are known, these have been developed for cosmetic effects and do not solve the present problem. Although the problem of providing sanitary facilities for pets has been approached, for example in U.S. Pat. No. 3,827,401 to Franzel, no known art provides an economical, sanitary, and convenient means for maintaining sanitary conditions around commodes and urinals.

SUMMARY OF THE INVENTION

The present invention is a mat adapted to be placed on the floor around the base of a commode or urinal and may be shaped to closely match the contours of the facility. The mat contains a replaceable pad which has an impervious plastic film as a base with layers of absorbent material overlaying the base, and a top film or sheet formed from a pervious preferably non-woven material. The top film or sheet may be attached around its edges to the edges of the plastic base to form an integral pad. This top film will allow fluids to pass therethrough and be absorbed by the layers of absorbent material while the impervious base film will prevent such fluids from escaping from the pad. Preferably, the absorbent material may be impregnated with any of the well known disinfectant and deodorizing chemicals.

The mat cover may be formed from resilient plastic or rubber like material and provided with a solid base and a hingedly-attached cover. Advantageously, the cover may be formed as a grille having large open areas therein.

In use, the mat is opened and the disposable pad is placed on the mat base. The cover is folded over to completely cover the pad and is secured to the mat base by simple clip or latch means. The grille work in the cover exposes the pervious membrane of the pad and the elements of the grille work are formed to encourage the flow of fluids into the pad. The pad may have a cutout portion such that when the pad is in place at the base of the commode, portions of the grille work and pad will be in front of the commode with narrow portions on either sides of the commode base extending toward the rear of the commode base.

A wide variety of materials, as will be apparent to those of skill in the art, may be used to form the mat cover portion of the invention. Preferably, for a permanent implementation of the invention, plastics such as PVC may be used. The material is selected so that the grille area of the cover is non-absorbent and is preferably treated to repel fluids by use of silicone compounds or the like. In such cases, a drop of urine striking an element of the grille would not adhere thereto but would roll off onto the absorbent pad. In an alternative form of the invention, a very low priced, disposable version may be made by forming the cover portion from a paper-type product which may be appropriately molded and coated with a moisture proof plastic coating.

The bottom surface of the cover portion of the commode mat may be formed to be skid-resistant. Where plastic or rubber-like material is used, the bottom surface may be covered with small protusions to form an anti-skid surface. With a paper product type cover portion, the bottom of the base may be covered with any of a variety of well known industrial anti-skid coatings.

In use, the mat is placed at the base of the commode or urinal so as to fit snugly around its base. At suitable intervals, depending on the number of persons using the facility, the mat is removed, the cover portion opened, and the used pad removed and disposed of. The mat cover portion may then be rinsed off in a sink or shower, allowed to dry, and a fresh pad installed therein. In the case of a low cost mat formed from paper products, the entire mat is discarded and a fresh mat installed.

It is therefore a principal object of the invention to provide a mat formed to fit around the base of a commode or urinal to catch and absorb urine that would otherwise strike the floor area.

It is another object of the invention to provide a sanitary commode mat having an absorbent pad for absorbing such urine.

It is yet another object of the invention to provide a mat having a cover section with grille work for protecting the absorbent pad and which may be opened to remove and replace the pad.

It is still another object of the invention to provide a sanitary commode mat having a grille work cover which is impervious to fluids and which will direct urine into the absorbent pad beneath the cover.

It is a further object of the invention to provide a sanitary commode mat having a non-skid bottom surface for maintaining the mat in close contact with a commode base or the like.

It is still a further object of the invention to provide a disposable pad having an impervious film base and a pervious film top sheet with moisture absorbing material sandwiched therebetween.

It is yet a further object of the invention to provide a disposable pad for absorbing urine in which the absorbent material is impregnated with disinfectant and deodorant chemicals.

It is an additional object of the invention to provide a disposable sanitary commode mat having a plastic coated cover portion having a grille work area and an inner moisture absorbing pad portion wherein the mat may be manufactured at very low cost to permit disposal thereof after short term use.

These and other objects and advantages of the invention will become apparent from the following detailed description when considered in conjunction with the drawings.

DETAILED DESCRIPTION OF THE PREFERRED EMBODIMENT

Figure 1:
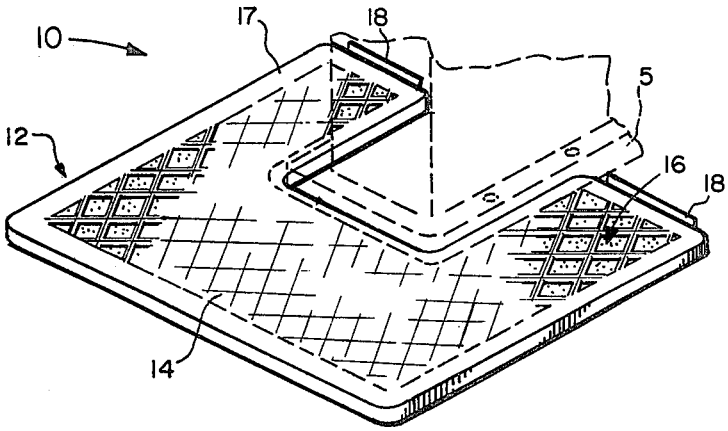
FIG. 1 is a perspective view of the sanitary commode mat of the invention in place around the base of the commode shown in phantom view.
Figure 3:
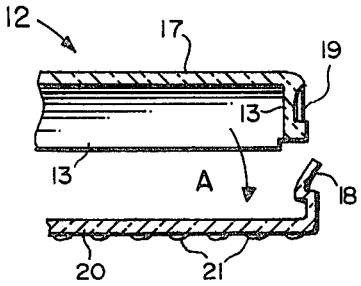
FIG. 3 is a cross-sectional view of a portion of the mat cover showing the latch means.
Figure 2:
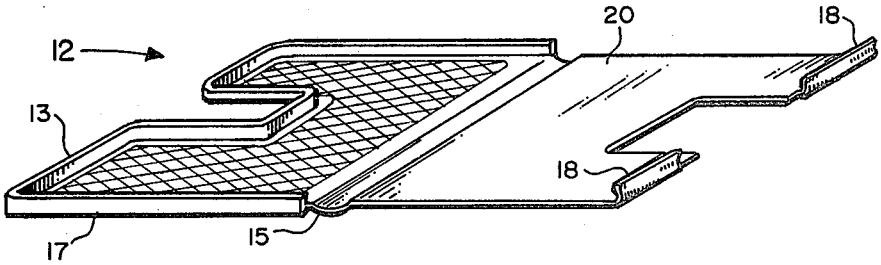
FIG. 2 is a perspective view of the cover portion of the sanitary commode mat shown in an open position prior to installation of the inner pad.

The present invention is a sanitary mat for use with commodes, urinals, and the like to maintain the floor area around such facilities in a clean, sanitary condition. The mat of the invention, as will be apparent to those of skill in the art, may be fabricated in a wide variety of shapes and forms. Basically, the mat is designed to fit snugly around the base of a commode or other facility for which protection is desired. Referring to FIG. 1, a particular design is illustrated for exemplary purposes and not to limit the scope of the invention. In this figure, a mat shown generally at 10 is tailored to fit the base of a commode 5 shown in phantom view. Mat 10 consists of a mat cover shown generally at 12 having an open grille work over the top surface. Mat cover 12 encloses an absorbent pad shown generally at 16 accessible through the openings in grille work 14. Cover 12 includes a latching means shown partially at 18 for maintaining the mat cover 12 closed when in use. The top cover section 17 of mat cover 12 is hinged to a base section 20 as best seen in FIG. 2 in which mat cover 12 is shown in its opened condition. Hinge 15 is a self-hinge type formed from the mat cover material as described below. Mat cover 12 is preferably fabricated from a smooth, resilient plastic material such as polyvinyl chloride (PVC) or of rubber or rubber-like material having a smooth surface, impervious to moisture. Mat cover 12 includes a rim 13 which extends downward beyond the lower surface of bottom plate 20 when cover 12 is in the closed position, as best seen in the cross-sectional view in FIG. 5. Hinge 15 may be formed from a web of the PVC material thinned down or scored to provide sufficient flexibility to act as a hinge. While any of a number of simple clip or latching devices may be utilized to hold top cover 17 closed during use, the simple self-latch design illustrated in the cross-sectional view of a portion of mat cover 12 in FIG. 3 is preferred. As may be noted, the lip portion 13 includes a molded notch 19, which will be engaged by latch bar 18 when top cover 17 is closed in the direction of arrow A. Due to the resilience of the material, latch bar 18 may be easily pushed outward with the fingers to open the cover. As may also be seen in FIG. 3, the bottom surface of cover base 20 may be provided with anti-skid elements 21, such as a multiplicity of small protrusions or fingers. Elements 21 serve to prevent slippage of mat 10 on smooth surface floors.

Figure 4:
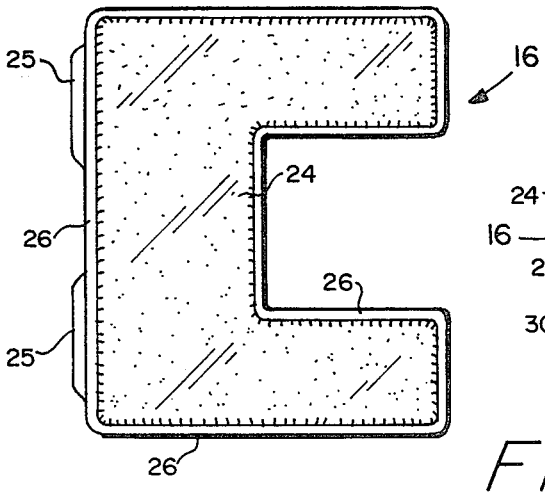
FIG. 4 is a plan view of the moisture absorbent pad of the invention.

As mentioned above, absorbent pad 16, shown in more detail in FIG. 4, is enclosed in mat cover 12 when mat 10 is in use. Pad 16 is constructed as may be noted with reference to FIGS. 4 and 5. A bottom sheet or film 30 is provided which is of an impermeable material and serves to maintain moisture within pad 16. Upper sheet or film 24 is fabricated from a moisture-permeable material which will allow fluids to pass therethrough. Between permeable film 24 and impermeable film 30, a moisture-absorbing cellulosic material 28 is disposed. The outer edges of upper sheet 24 and lower sheet 30 are sealed together as indicated at 26 by a thermal seal or with an adhesive. This construction forms an integral pad which can retain any moisture asbsorbed therein. For convenience of handling pad 16, particularly after extended use, tabs 25 may be included as extensions of lower sheet 30 as seen in FIG. 4. In use, pad 16 is laid on mat cover base 20 with mat cover 12 opened as shown in FIG. 2. Mat cover 17 is folded over and latched closed as previously described. After use, sanitary mat 10 is removed from the facility, opened out by releasing latch bar 18 and the used pad 16 lifted out by means of tabs 25 and disposed of. Mat cover 12 is then rinsed off, a fresh pad 16 installed, and the mat returned to its point of use.

Figure 5:
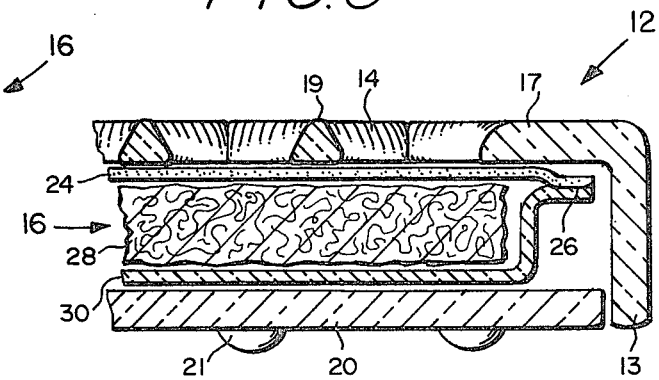
FIG. 5 is a partial cross-sectional view of the cover portion of the mat with the absorbent pad of FIG. 4 shown in place and showing the preferred shape for the grille elements.

A preferred construction of grille work 14 is illustrated in the partial cross-sectional view of FIG. 5. A cross-section of a grille element 19 may be noted to have a general triangular shape such that urine contacting elements of grille work 14 will drain off into pad 16. The surfaces of grille elements 19 are smooth and are preferably treated to prevent adherence of liquids to ensure collection by pad 16.

A number of sanitary pad designs are available in the art which are suitable for pad 10. Such pads have commonly been developed as disposable diapers and the like. For example, a disposable diaper is described in U.S. Pat. No. 3,815,602 to Johns, et al and which discloses materials particularly suited for fabrication of absorbent pad 16. In accordance with such disclosure, permeable upper film 24 may be formed from a fabric produced as described in U.S. Pat. No. 3,485,706 which provides a fabric-like product having an appertured, non-woven cover fabric of unbonded staple fibers with an entanglement completeness of about 0.5. The fabric may be formed from polyester fibers and with the addition of a small percentage of cellulosic fibers if desired. The purpose of the permeable cover sheet 24 is to allow urine falling on the top surface of pad 16 to penetrate therethrough and to be absorbed by absorbent material 28. Thus, by restricting the urine to the inner absorbent layers, odors from the mat may be minimized. Many suitable moisture absorbing materials are well known; for example, paper or wood pulp crepe wadding, wood fluff, or various combinations of such cellulosic products are suitable. A satisfactory material is that utilized in "Newborn Pampers" made by the Proctor & Gamble Company. This material comprises seven layers of 1 oz/yd$^2$ crepe wadding embossed together in a pattern. The impermeable bottom sheet 30 is preferably polyurethane sheet plastic which may have a thickness of 0.002 inches to 0.004 inches.

Other suitable absorbent materials which are commercially available include "Durabsorb" manufactured by Parke-Davis. A cellulosic product taught by Voightman, et al in U.S. Pat. No. 3,036,573 is also suitable. The present invention also contemplates the use of germicidal and deodorant agents in the moisture absorbent material 28. Such agents will assist in minimizing odors and bacteria growth during use of a particular pad. As taught by Voightman, quaternary ammonium compounds used in an amount between 0.3 to 1 percent by weight are effective. Other compounds which may be used for antiseptic and deodorant purposes are described in U.S. Pat. No. 2,634,229.

As may now be recognized, a simple and effective sanitary commode mat has been described which utilizes a disposable and replaceable moisture absorbing pad which may include germicidal and deodorant agents. The commode mat will prevent urine stains and odors from the floor area surrounding the commode or urinal, and greatly reduce necessary cleaning operations to maintain bathrooms and restrooms in a clean sanitary condition. The urine absorbing pad contained in the sanitary mat may be periodically disposed of and replaced at low cost, and the mat cover quickly and easily rinsed for reuse.

Figure 6:
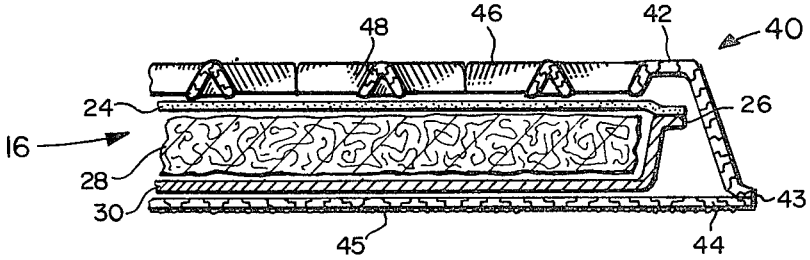
FIG. 6 is a cross-sectional view of a disposable version of the invention in which the cover portion is fabricated from a paper product.

Although the sanitary commode mat described above is economical and effective, an alternative embodiment in which the entire mat is disposable may be more suitable for certain applications. Turning to FIG. 6, a cross-sectional view of a portion of such embodiment is shown. It is to be understood that otherwise the disposable mat has the same general appearance as the preferred embodiment shown in FIG. 1. The disposable mat shown generally at 40 comprises an outer cover 41 consisting of an upper grille section 42 and a base plate 44. The cover and grille section 42 and base plate section 44 are fabricated from a pressed paper product, molded as required, and having a thin plastic coating on either side thereof. Moisture absorbent pad 16 is identical in construction to that used in the preferred embodiment. However, upper grille section 42 of mat 40 is bonded permanently to base section 44 as indicated at 43. Any well known bonding process such as the use of industrial cements and the like may be used. An anti-skid coating 45 is disposed on the bottom surface of base plate 44 to maintain mat in the desired position around the commode. Grille work 46 is molded with grille bars 48 in an inverted V-shape as seen in cross-section. The triangular V-shape of grille bars 48 and the plastic coating on the surface thereof causes urine falling on the grille surfaces to quickly drain into absorbant pad 16. Due to the low material costs in this embodiment of the invention, it is economical to simply replace the mat and to dispose of the old mat after sufficient use.

I claim:

1. A sanitary commode mat adapted to be placed around the base of a sanitary facility such as a commode or urinal, for collecting and absorbing urine, comprising:

a moisture absorbent pad formed to essentially conform to the base of said sanitary facility for receiving and absorbing urine falling on said mat; and a cover assembly adapted to contain said pad and having a top surface thereof formed by an open grille work and a bottom surface thereof formed by a solid base, said cover assembly conforming to the shape of said pad, wherein said moisture absorbent pad is disposed between said open grille work and said solid base of said mat cover.

2. The mat as defined in claim 1 in which said top surface of said mat cover is hingedly attached to said solid base of said mat cover whereby said mat cover may be opened for removing and replacing said moisture absorbent pad.

3. The mat as defined in claim 1 in which said moisture absorbent pad comprises:

an impermeable film forming a lower base sheet for said pad;

a moisture absorbing layer of cellulosic material slightly smaller than said impermeable film, said layer disposed upon said base sheet;

a permeable film forming a top sheet having a matching shape and size to said impermeable film, said permeable film overlaying said moisture absorbing layer and said impermeable film, the borders of said permeable film and said non-permeable film bonded together to thereby enclose said moisture absorbing layer.

4. The mat as defined in claim 3 in which said impermeable film is formed from a polyethylene plastic;

said permeable film is formed from a non-woven cover fabric of unbonded staple fibers having incomplete intanglement thereof; and said moisture absorbing layer is formed from a plurality of layers of crepe wadding embossed together.

5. The mat as defined in claim 4 in which said border of said impermeable film includes at least one tab extending therefrom for use in handling said moisture absorbing pad without contact with a contaminated pad.

6. The mat as defined in claim 3 in which said moisture absorbing layer is treated with a germicidal agent.

7. The mat as defined in claim 3 in which said moisture absorbing layer is treated with a deodorant agent.

8. The mat as defined in claim 1 in which said mat cover is formed from a polyvinyl chloride plastic material treated to prevent adherence of urine thereto.

9. The mat as defined in claim 8 in which the bottom surface of said solid base of said mat cover is provided with an anti-skid surface.

10. The mat is defined in claim 8 in which the elements of said open grille work have a triangular shape for allowing urine falling thereon to flow onto said pad from said elements.

11. The mat as defined in claim 2 in which said mat cover and said solid base have latching means for maintaining said mat cover in a closed position during use and for permitting opening of said mat cover for removing and replacing said moisture absorbent pad.

12. The mat as defined in claim 8 in which said top surface is hingedly attached to said solid base by a hinge formed from said polyvinyl chloride plastic material.

13. A sanitary commode mat adapted to fit around the base of a sanitary facility such as a commode or urinal, comprising:

A. protective mat cover means contoured to conform to the base of a sanitary facility and formed from a resilient material, said mat cover means having (i) a base section, (ii) a top section hingedly attached to said base sections to permit opening and closing of said mat cover means, (iii) latch means for holding said mat cover means in a closed position, and (iv) open grille work comprising the major area of said top section, said grille work having grille elements of essentially triangular shape and treated to be moisture repellent such that urine falling on said grille elements will not adhere thereto; and B. moisture absorbing pad means for receiving and absorbing urine falling on said pad means and draining from said moisture repellent grille elements, said pad means disposed between said base section and said top section of said mat cover means in its closed position and having (i) an impermeable film forming a base sheet for said pad means, (ii) moisture absorbing layers of cellulosic material slightly smaller then said impermeable film and disposed upon said base sheet, (iii) a permeable film forming a top sheet of said pad means having a matching shape and size to said impermeable film, said permeable film overlaying said moisture absorbing layers and said impermeable film, the borders of said permeable film and said impermeable film bonded together to thereby enclose said moisture absorbing layers, and (iv) the bonded together borders of said films forming at least one tab projecting from said pad means;

whereby said mat cover means serves to protect said pad means from damage, said pad means is removable from said cover means when open by grasping said tab without contact with contaminated portions of said pad, and wherein a contaminated pad is replaceable with a fresh pad.

* * * * *